United States Patent [19]

Sigler et al.

[11] Patent Number: 4,819,279

[45] Date of Patent: Apr. 11, 1989

[54] VACUUM TOILET SYSTEM

[75] Inventors: James Sigler; Richard W. Sprang; Ronald J. Bailey; Edward McKiernan, all of Big Prairie, Ohio

[73] Assignee: Sealand Technology, Inc., Big Prairie, Ohio

[21] Appl. No.: 101,788

[22] Filed: Sep. 28, 1987

[51] Int. Cl.[4] ..... F03D 1/00

[52] U.S. Cl. ..... 4/300; 4/321; 4/323; 4/342; 4/362

[58] Field of Search ..... 4/362, 321, 323, 342, 4/314, 300

[56] References Cited

U.S. PATENT DOCUMENTS

| | | | |
|---|---|---|---|
| 3,599,248 | 8/1971 | Fulton | 4/438 |
| 3,663,970 | 5/1972 | Drouhard, Jr. et al. | 4/319 |
| 3,727,241 | 4/1973 | Drouhard, Jr. et al. | 4/319 |
| 3,811,135 | 5/1974 | Drouhard, Jr. et al. | 4/435 |
| 4,521,925 | 6/1985 | Chen et al. | 4/362 |

OTHER PUBLICATIONS

"Vacu-Flush ®", Owner's Manual.

"The Mansfield Vacu-Flush ® System" brochure.

*Primary Examiner*—A. D. Pellinen

*Assistant Examiner*—Morris Ginsburg

*Attorney, Agent, or Firm*—Nixon & Vanderhye

[57] ABSTRACT

A vacuum toilet system for a vehicle (such as a boat) has numerous advantages. A single pump with valves on opposite sides of it may be used as both the vacuum source and for discharging sewage from a holding tank. Two sets of multiple heads may be selectively connected to two pumps for emergency purposes. The vacuum toilet includes a sealing element with an integral movable valve engaging element including polytetrylflouroethylene and synthetic rubber, and at the same durometer (55–65). The initial passageway provided by movement of the valve with respect to the seal is disposed directly above the center line of an orifice. An anti-siphon valve assembly has a simple construction of a housing with parallel legs and anti-siphon air passage in alignment with one of the legs. A spray nozzle extends from the other legs of the anti-siphon valve assembly. The toilet funnel/orifice is universally connected to conduits. The vacuum tank is blow molded of plastic, has universal ports including one continuous from the tank walls so that no accumulation takes place in the tank. Longitudinal ribs along the tank provide for easy connection to a support. A vacuum sensor is mounted to one of the vacuum tank ports with fasteners disposed exteriorly of the tank, and without the need for an O-ring. The pump comprises a rolling diaphragm pump in a housing with a sump, and the stem from the pump is plastic with pegs that are staked or ultrasonically welded to the movable pump element. A powdered metal crank arm connects the pump stem to a drive motor, the crank arm being the fail-safe part of the pump.

10 Claims, 8 Drawing Sheets

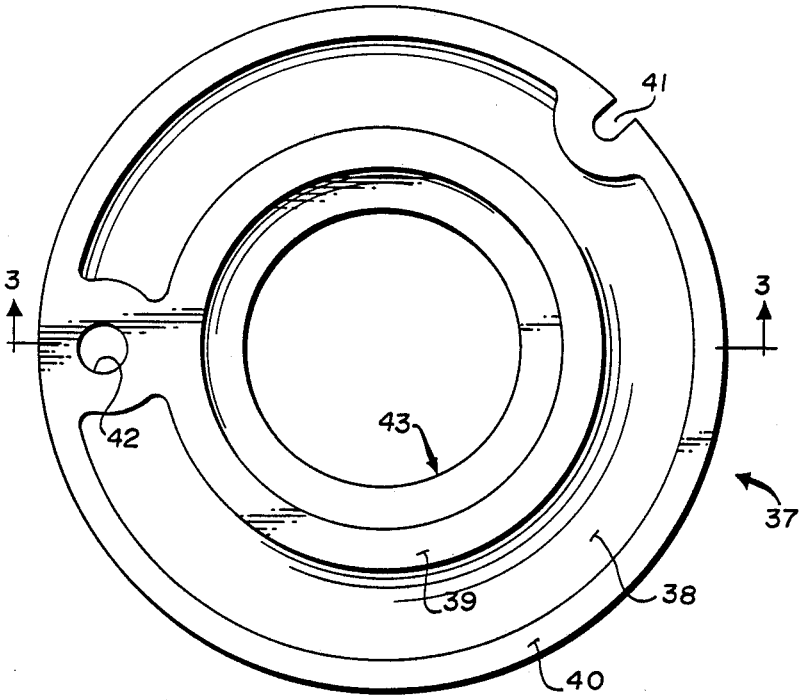
FIG. 4
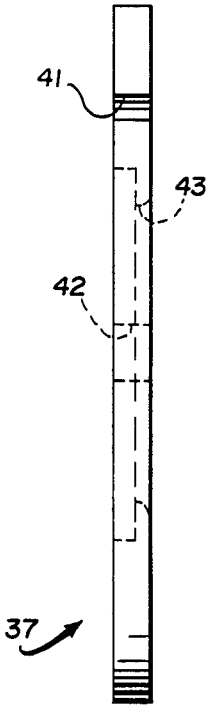
FIG. 5
FIG. 3
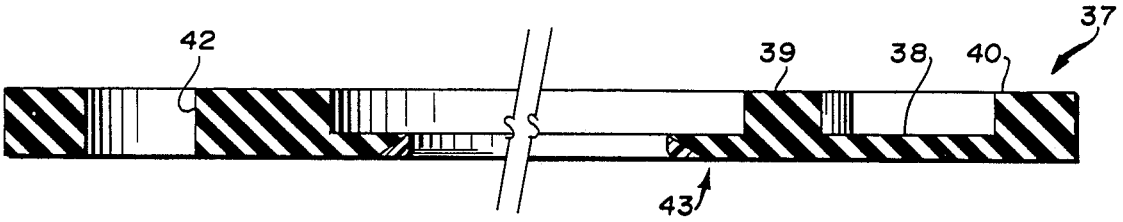

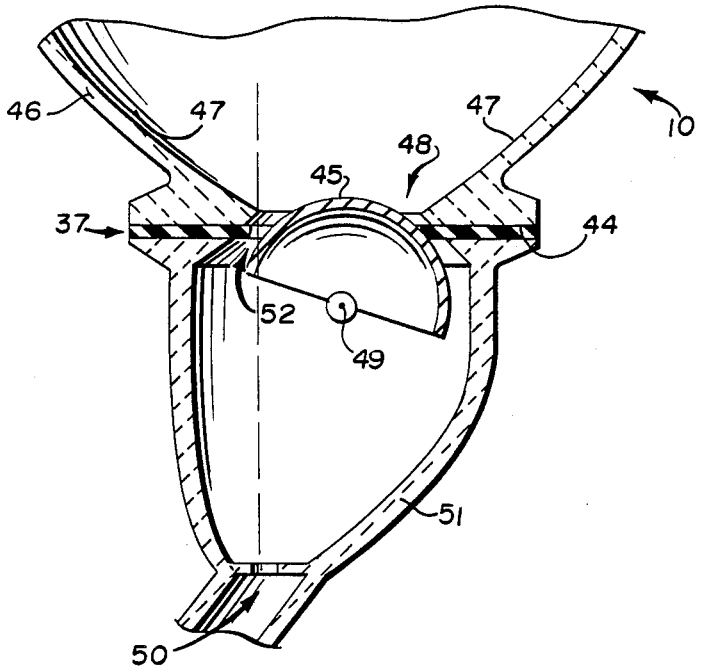
FIG. 6
FIG. 7
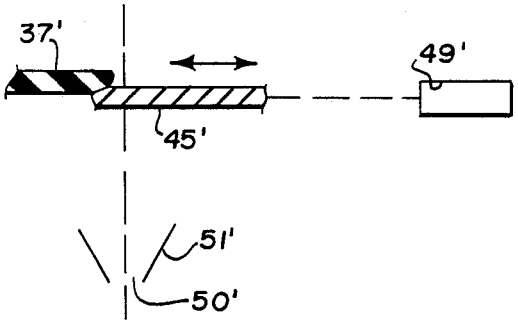
FIG. 8
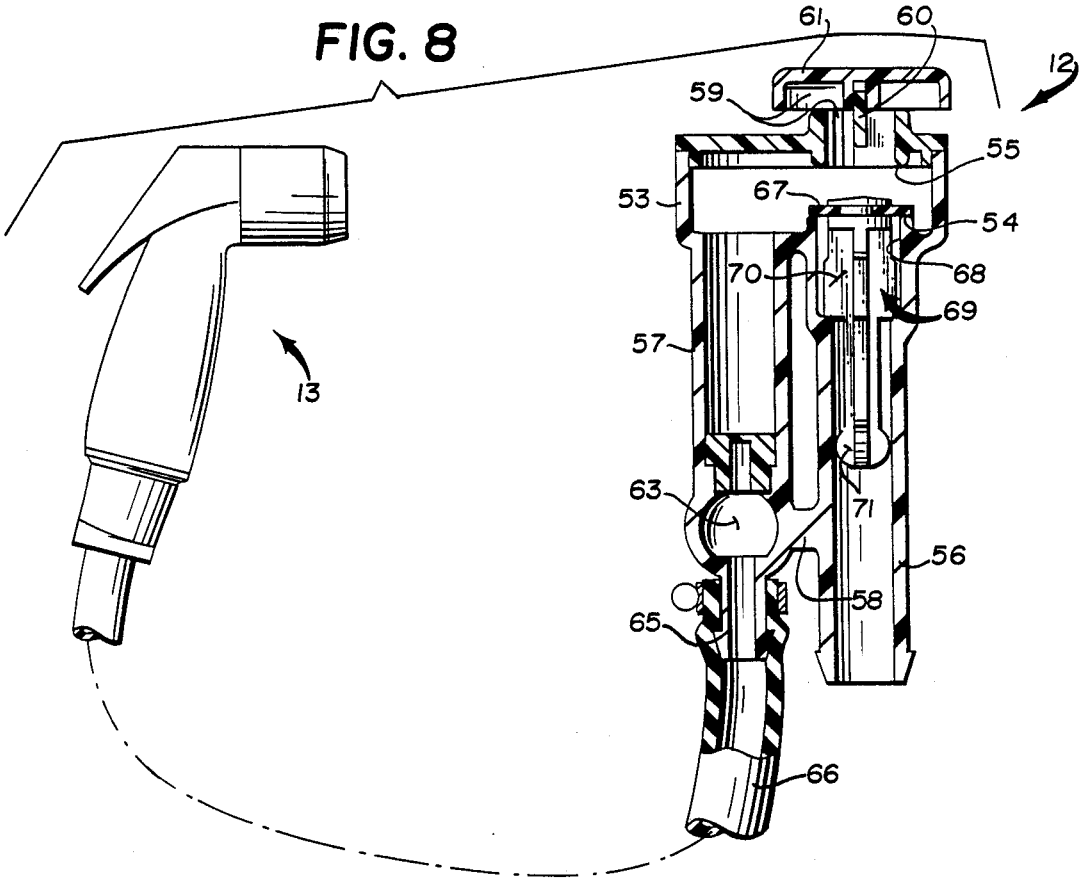

FIG. 23
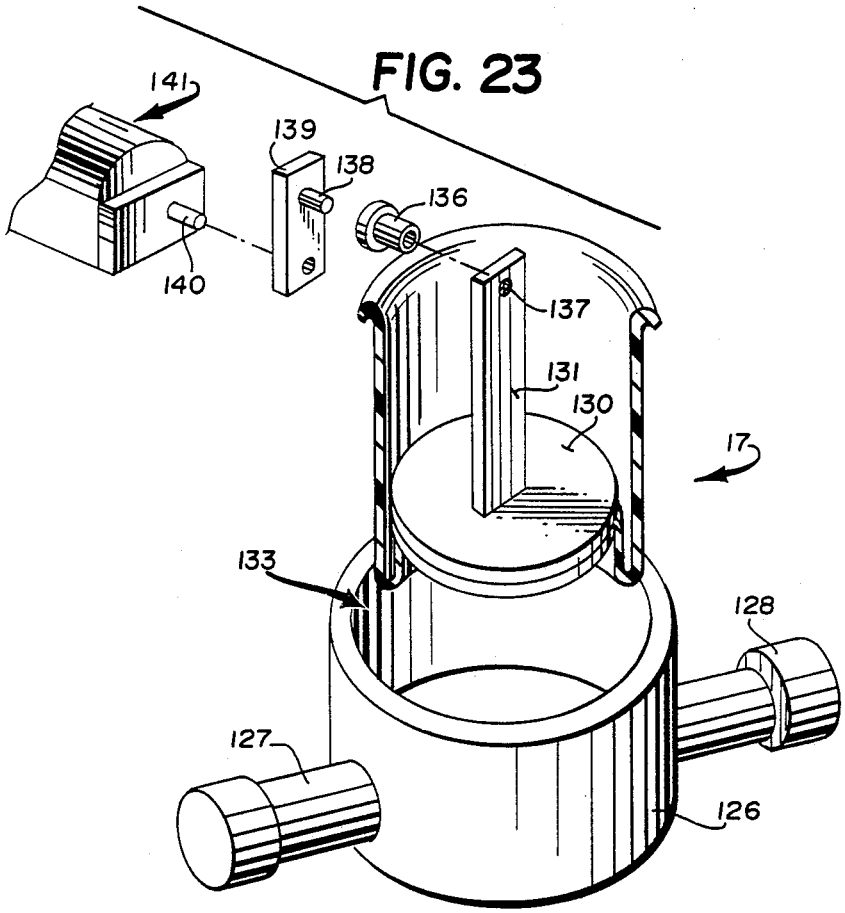
FIG. 24
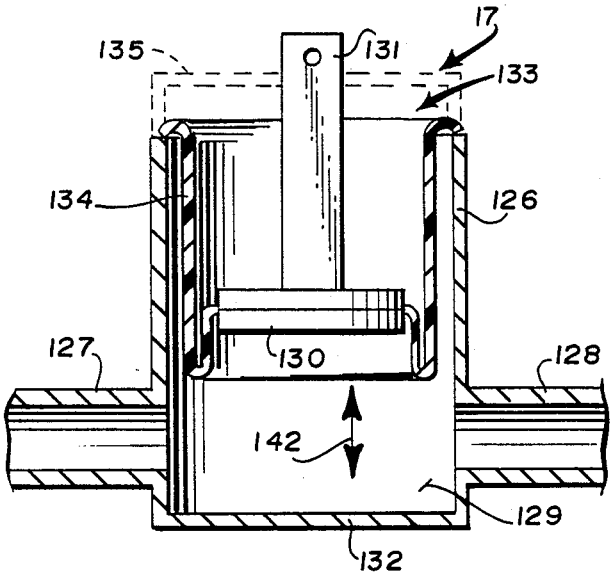
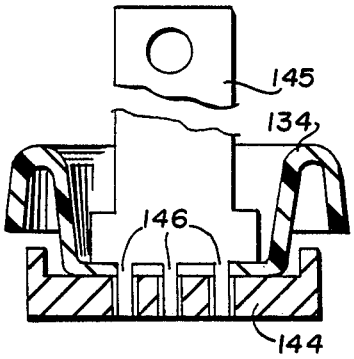
FIG. 25

VACUUM TOILET SYSTEM

BACKGROUND AND SUMMARY OF THE INVENTION

The invention relates to vacuum toilet systems, particularly for use on vehicles such as boats, planes, trains, recreational vehicles, and the like, and to component parts for such systems. Vacuum toilet systems, such as those sold for many years under the "Vacu-Flush" ® trademark have had many practical advantages including being able to flush without using large amounts of precious clean water, low energy use per flush, excellent system flexibility, and the avoidance of using macerators or other accessory pieces of equipment to break up the sewage. While the Vacu-Flush ® system has been very commercially successful, there are some aspects thereof that can be improved upon as far of ease of construction, optimization of functionality, and minimization of the number of components is concerned. According to the present invention a vacuum toilet system, and various components thereof, are provided which retain the numerous advantages of the Vacu-Flush ® system, yet improve upon it.

One important element of a vacuum toilet is a flexible seal between the bowl and the vacuum source which cooperates with the movable valve element. In the past such seals have been constructed solely of synthetic rubber or like elastomeric material, or have been formed of two different materials (such as in U.S. Pat. No. 3,599,248) including a ring of material such as polytetraflouroethylene having a low coefficient of friction and inherent lubricity, which is bonded to the synthetic rubber major portion of the seal. If a sealing element solely of synthetic rubber is utilized there is not enough lubricity between the movable valve element and the seal, and where a separate Teflon ® ring is utilized there are difficulties in construction and bonding between the components. Also, in view of the fact that such seals are preferably used in association with china (ceramic) bowls, the inherent irregularities in the china bowl may cause problems in effecting an appropriate seal between the bowl and the sealing material itself.

According to the invention these difficulties have been overcome by molding the sealing element in a particular way. The sealing element includes an annular one-piece element of resilient material having a body and first and second radially spaced concentric rings upstanding from the body. The radially spaced upstanding rings provide effective sealing with the ceramic bowl, despite the high degree of irregularity thereof. The body is of a first material, preferably synthetic rubber, while an inner flap portion is integral with the body but is of a second material having greater lubricity, such as synthetic rubber blended with polytetraflouroethylene. When providing the sealing element as an integral structure the durometer of the entire seal can be the same throughout (e.g. about 55–65), with desired results in achieving proper sealing over long periods of time.

In past vacuum toilet systems there have been many situations in which it has been desirable to pump the sewage to a holding or treatment tank, and then when the holding or treatment tank is full to discharge the sewage therefrom. This has typically required the utilization of two pumps. According to the invention, however, the necessity for two pumps has been eliminated, and by placing three-way valves on opposite sides of a single pump, the holding tank may be either filled or emptied utilizing a single pump. Also in conventional systems, having multiple heads, if a pump broke down all of the heads associated with that pump would be rendered inoperable. According to the invention, conduits associated with multiple heads are interconnected in such a way that if one pump breaks down another pump associated with another set of heads may be utilized to serve both sets of heads for a short period of time until repairs can be effected.

In the successful Vacu-Flush ® vacuum toilet system, maceration has been achieved without the necessity of mechanical macerating elements or the like. It has always been thought that the majority of maceration was provided at an orifice which is provided several inches below the valve on the opposite side from the toilet bowl. However, upon further study of the mechanisms involved, it has now been determined that the majority of the maceration takes place when the solid sewage material is first exposed to the vacuum source by initial "cracking open" of the valve. In view of this, it becomes desirable to place the orifice means (which preferably comprises a knife-edge orifice), at the bottom of the funnel leading to the orifice means, directly below the portion of the valve where the initial passageway is formed when the valve is opened. In this way, the waste need undergo minimum changes in direction, which should accentuate the fragmenting action that is provided. Variable shapes of the funnel and orifice may be provided to further enhance this action, and valve opening can be provided by a reciprocal movable valve element or a conventional hemispherical ball rotating valve element.

Conventional vacuum toilets—since they use a small volume of water—typically are flushed with fresh water from a storage facility on the vessel or vehicle rather than utilizing sea water or polluted water. This has a number of advantages, of course, in insuring longevity and proper operation of the system. However, when supplying fresh water to a vacuum system, it is necessary to ensure that a siphoning effect does not occur during the flushing of the toilet. This is typically accomplished utilizing an anti-siphon valve or "vacuum-breaker" mounted on the bowl. While conventional anti-siphon valves have performed the desired functions, they normally have been relatively complicated in construction the bodies being relatively difficult to mold and containing significant amounts of plastic.

According to the present invention, an anti-siphon valve is provided which has a number of advantages of simplicity of construction and operation and minimization of material, compared to conventional vacuum-breakers utilized in vacuum toilet systems and additionally allows for ready connection of a hand operated nozzle spray head so that the bowl may be rinsed in particular portions thereof with small amounts of water rather than relying merely upon where the water is directed by the conventional attachment of the anti-siphon valve to the toilet bowl.

In conventional vacuum toilets, the connection between the orifice of the bottom of the funnel and a conduit leading to the vacuum tank provides for rather limited flexibility. However, according to the invention, a collar can be provided around the knife edge orifice at the bottom of the funnel, the collar surrounding the orifice, and the collar providing a female connection for cooperation with a wide variety of different conventional connectors, including rigid one and one half inch pipe, one and one half inch inside diameter hose, or Ls for connection to hose or pipe.

The vacuum tank in conventional vacuum toilet systems has had a number of practical difficulties. The ports extending to and from the tank are of widely different construction, minimizing the flexibility of connection of various components to it. Also, the tank has been mounted utilizing a mounting base and clamping strap system that is less than desirable, and because of the cooperation of the outlet from the tank and the tank itself, liquid (which includes sewage particles) can collect at the bottom of the tank. The provision of sewage constantly in the tank is undesirable for many reasons.

According to the invention, however, a vacuum tank is provided which eliminates these drawbacks. The tank is preferably formed by blow molding plastic so that it has no seams. It is constructed so that it has universal ports so that any of a number of different elements can be connected to any of the ports, providing maximum flexibility for installation of the system. At least one of the ports is constructed so that it has as a portion thereof as a continuation of the side wall of the circular-cross section of the tank, so that no accumulation of sewage within the tank ever occurs if that port is used as the outlet port. Further, ribs are integrally molded on the outside of the tank extending in the direction of elongation of the tank, the ribs including a plurality of through extending openings which are substantially tangential to the tank and adapted to directly connect to a bracket for bolting of the tank to the bracket. By providing four equally circumferentially spaced longitudinal ribs on the tank maximum flexibility in the mounting of the tank and orientation of the various ports is provided.

One conventional component that is mounted to the vacuum tank is the vacuum switch, which is responsive to the degree of vacuum in the tank and controls the vacuum pump when the level of vacuum drops (i.e. after a "flush" of a toilet associated with the tank). An electrical switch is typically mounted to the tank utilizing a plug adaptor and supporting mount, however, those components have usually required the utilization of stainless steel screws and an O-ring. The stainless steel screws were necessary since the plug adaptor and the switch support were connected together from the interior of the vacuum tank. According to the invention, a plug adaptor and a vacuum switch support mount are provided that cooperate in such a way that the screws may be provided into blind hole from the exterior of the vacuum tank so that stainless steel screws need not be utilized, and the base of the support mount is constructed in such a way that the O-ring is eliminated.

A conventional pump utilized in prior vacuum toilet systems is of the type such as in U.S. Pat. Nos. 3,529,908, 3,597,516, 3,714,536, 3,774,461. Such a pump is self-priming and handles solids up to one-half an inch, and contains dual check valves and a bellows associated with the movable pump element (piston). While such a pump is ideally suited for vacuum toilet systems, it has one operational drawback in that paper, from the toilet paper utilized with the system, tends to pack around the bellows and breaks down ultimately limiting the length of travel of the movable pump element and causing significantly decreased operational efficiency. This is avoided according the present invention by utilizing a rolling diaphragm pump instead of a bellows pump.

Further, the components of the conventional vacuum pump are relatively expensive and the expense of such a pump is significantly reduced according the invention by utilizing a plastic stem which has pegs extending from it that are staked or ultrasonically welded to a movable valve element. Further, a powdered metal crank arm is provided for transferring the motive force from the pump and gear reducer to the stem for reciprocating the movable valve element. The powdered metal crank arm can—in addition to being less expensive than a conventional solid metal crank arm—provide a fail-safe mechanism, which will fail before other components of the motor crank or pump system which are more expensive to replace, such as a gear reducer, or motor itself.

The vacuum toilet system, and components thereof, according to the invention have numerous advantages over the prior art while retaining the desirable features of the commercially successful prior "Vacu-Flush" ® system. This and other objects of the invention will be become clear from an inspection of the detailed description of the invention and from the appended claims.

BRIEF DESCRIPTION OF THE DRAWINGS

FIG. 3 is a side cross sectional view of an exemplary flexible sealing element utilized in the vacuum toilet of FIG. 1;

FIG. 4 is a top plan view of the sealing element of FIG. 3;

FIG. 5 is a side view of the sealing element of FIG. 3;

FIG. 6 is a side partial cross sectional view of an exemplary vacuum toilet according to the invention which maximizes macerating operations by taking into account the point where the majority of fragmentation occurs;

FIG. 7 is a side schematic view of portions of toilet like that of FIG. 6 only showing a reciprocal valve element instead of a rotary one;

FIG. 8 is a side view, partly in cross section and partly in elevation, of an exemplary anti-siphon valve with spray nozzle utilized in the vacuum toilet system according to the invention;

FIG. 23 is an exploded perspective view of an exemplary vacuum pump according to the invention;

FIG. 24 is a side view, partly in cross section and partly in elevation, of just the pumping components of the the pump of FIG. 23; and FIG. 25 is a detail side view, partly in cross section and partly in elevation, of the interconnection between a desirable pump stem and movable pump element of a vacuum pump that can be utilized according to the present invention.

DETAILED DESCRIPTION OF THE INVENTION

Figure 1:
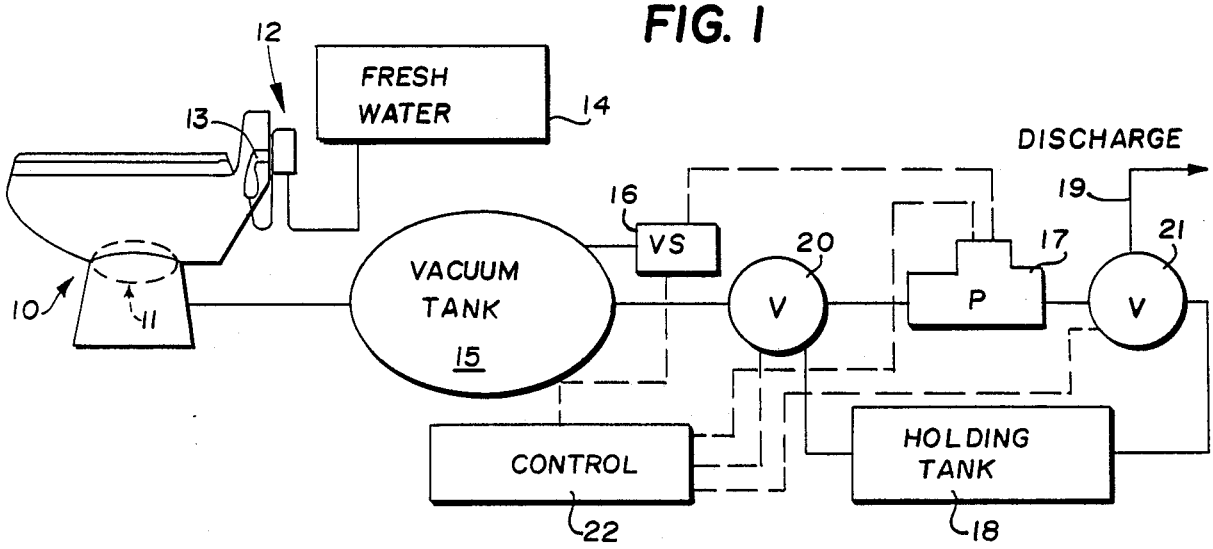
FIG. 1 is a schematic view of an exemplary vacuum toilet system, according to the invention, which utilizes a single pump for filling and emptying the holding tank.

FIG. 1 shows most of the major components of a conventional vacuum toilet system for a vehicle, such as a boat, but interconnected in a particularly advantageous system according to the invention and utilizing advantageous component parts according to the invention. The basic components of the system include a vacuum toilet 10 which includes a movable valve element interior thereof, shown in dotted line at 11, and an anti-siphon valve 12 with a spray nozzle 13 associated therewith and connected to an on-board source of fresh water 14. The toilet 10 is operatively connected, below the toilet valve 11, to a vacuum tank 15 which is an accumulator of vacuum, and has a vacuum switch assembly 16 operatively associated therewith, as well as a vacuum pump 17 and a holding (or treatment) tank 18. Sewage may ultimately be discharged from the system through discharge conduit 19.

According to the system of the invention of FIG. 1, filling or emptying of the holding tank is accomplished utilizing a single pump 17 rather than requiring two pumps as is conventional in the prior art, by utilizing a pair of three-way valves 20, 21 which are preferably solenoid operated valves or the like which are controlled from a common control console 22 or the like. When first valve 20 and second valve 21 are in respective first positions thereof, the vacuum pump 17 will pump sewage from vacuum tank 15 through valve 20, through it, and then through valve 21 to holding tank 18. In a second position of valves 20, 21, the pump 17 will pump sewage from holding tank 18, through valve 20, to pump 17, through valve 21, and to discharge conduit 19.

Figure 2:
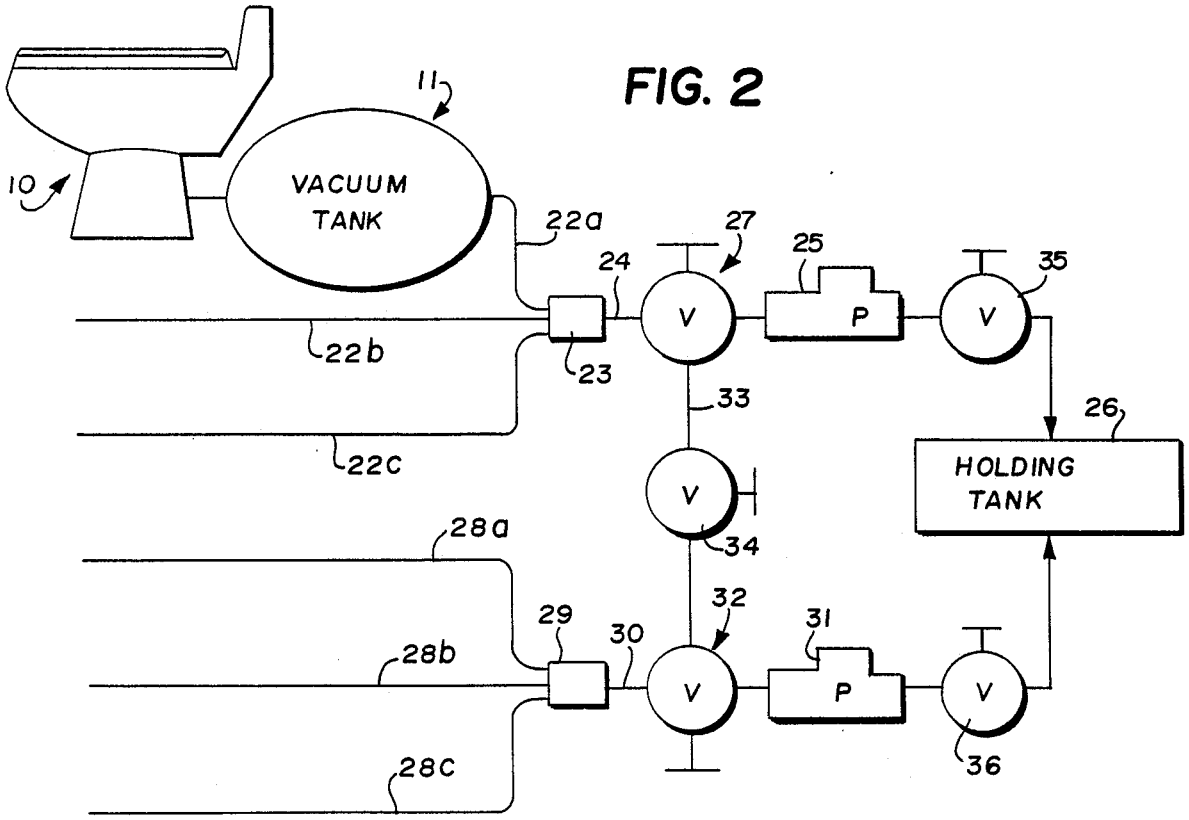
FIG. 2 is a side schematic view of an exemplary vacuum toilet system according to the invention which allows flexibility of use, and operation even if one pump becomes temporarily inoperative.

FIG. 2 illustrates a multiple head system such as would be used in train cars or the like which will allow continued operation even if one of the vacuum pumps breaks down. A first plurality of vacuum toilets 10 and associated vacuum tanks 15 is associated with each of the lines 22*a*–22*c*, connected to a header 23 or the like and passing in first conduit 24 to first vacuum pump 25 and then to a holding tank 26. A first valve 27 is provided in conduit 24 between header 23 and pump 25. A second plurality of lines 28*a*–28*c* are connected to a second plurality of heads, to header 29, second conduit 30, and second vacuum pump 31. A second valve 32 is disposed in conduit 30 between header 29 and pump 31. A third conduit 33 is provided connected between the valves 27, 32, so that with the valves 27, 32 in the appropriate position—as well as third valve 34 in the appropriate position—all the sewage from the first header 23 may pass to the vacuum pump 31 in addition to that from lines 28*a*–28*c*; or alternatively the sewage from header 29 may pass to first pump 25. The fourth and fifth valves 35, 36 also may be provided between the pumps 25, 31 and holding tank 26. The holding tank 26 is connected to a discharge in any conventional manner. All the valves may be manually operated valves as indicated in the drawing, or may be solenoid operated. Valves 35, 36 may be check valves in the appropriate circumstances.

FIGS. 3–5 show a sealing element for the toilet valve 11 pursuant to the invention. The sealing element illustrated in FIGS. 3–5 is substituted for the sealing element 10 in the toilet of the U.S. Pat. No. 3,599,248 (the disclosure of which is hereby incorporated by reference herein), and may also be seen in FIG. 6 the sealing element 37 comprises an annular one-piece sealing element of resilient material having a body 38 of a first material (preferably synthetic rubber) and radially spaced concentric rings 39, 40 upstanding from the body 38. As is conventional in such sealing elements a positioning peg-engaging slot 41 is provided in the periphery of the element 37 including in the concentric ring 40. Also, means defining an overflow opening 42 is integrally molded into the sealing element 37. The sealing element also includes an inner annular flap portion 43 which is of a second material having greater anti-friction and lubricity properties than the first material, preferably synthetic rubber blended with Teflon® (polytetraflouroethylene). The upstanding radially spaced rings 39, 40 engage a bottom surface 44 of toilet bowl 10 (see FIG. 6) and provide effective sealing despite the inherent irregularities of the bowl 10 when it is formed of china (ceramic) as is desirable.

The inner flap 43, which must have a minimum thickness of about 0.062 inches, actually engages the movable valve element (e.g. hemispherical element 45 in FIG. 6) to effect sealing. The durometer of the sealing element 37 is about 55–65, preferably about 60, and thus entire element 37 can be molded in a single mold. For example the inner flap 43 may be white buna-n synthetic composition number 2653, mixed with Teflon, while the body 38 (and rings 39, 40) could be black buna-n synthetic rubber, composition number 2319.

FIG. 6 illustrates a toilet 10 with a conventional toilet bowl 46 with downwardly sloping sides 47 defining a drain opening 48 with the bottom surface 44 surrounding the drain opening 48. The valve element 45 is rotatable about axis 49 to move into and out of sealing engagement with an entire periphery of the inner flap 43 of the sealing element 37 to open or close the drain opening 48. In the FIG. 6 embodiment, the components are located in such a way as to optimize the macerating action that inherently results in vacuum toilet systems (without the need for an accessory macerating device).

As previously stated, it has been recognized according to the invention that instead of the majority of the macerating action taking place at an orifice—such as at the orifice 50 located below the drain opening 48 at the bottom of the converging walls of the funnel means 51—it takes place at the point where the valve is initially "cracked open" and the waste material is initially exposed to the force of the vacuum on the opposite side of valve element 45 from the bowl 46. Upon rotation of the valve element 45 about axis 49, an initial passageway or opening 52 is provided and this is where the macerating action takes place, or at least significant fragmentation occurs there so as to enhance any subsequent fragmentation that occurs. In view of this recognition, according to the invention, in the vacuum toilet of FIG. 6 the components are located so as to take maximum advantage of this condition. In particular, the orifice 50 and particularly the center line thereof, is disposed so that it is disposed directly below (in vertical alignment with) the initial passageway 52 so that the waste material does not change direction in moving to orifice 50 and need not follow any unnecessarily long path. This facilitates the fragmenting action.

In the schematic embodiment of FIG. 7, the valve element 45' is a linearly reciprocal valve element operated by a linear actuator 49' or the like, cooperating with the sealing element 37'. Here, again, the orifice 50' at the bottom of funnel means 51' is disposed so that it is directly below and in vertical alignment with the initial passageway that is created when the movable valve element 45' is first reciprocated to the right in FIG. 7.

In the construction of vacuum toilet systems, typically the orifice 50, 50' would be about one inch in diameter and that would be the smallest diameter portion of any part of the system so that if a piece of waste material makes it past the orifice 50, 50' (which preferably comprises a knife-edge orifice), it will be able to move throughout the rest of the system.

Figure 9:
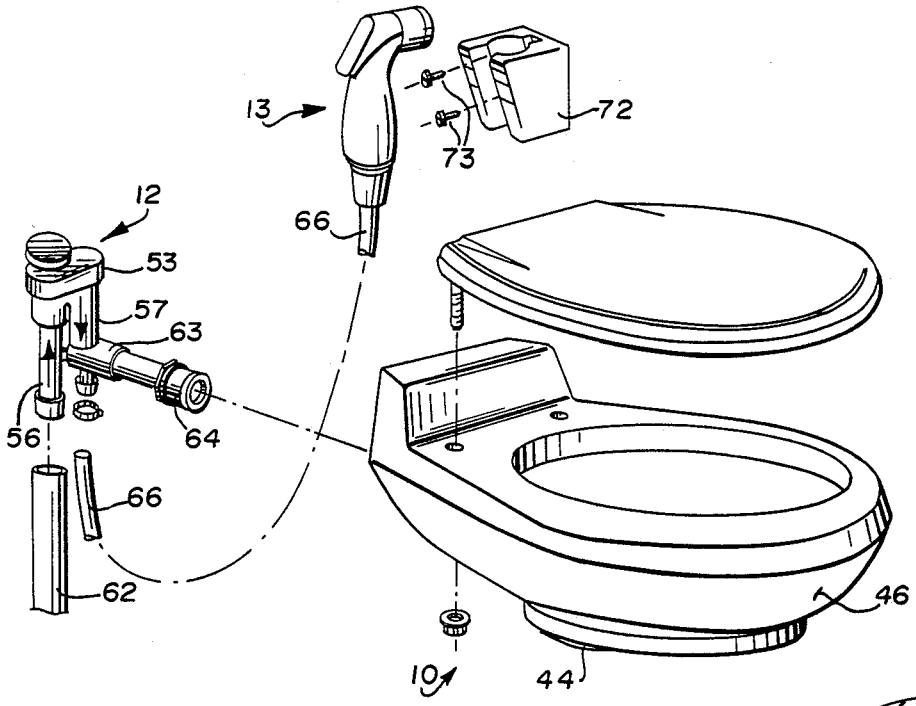
FIG. 9 is a perspective view of the anti-siphon valve and spray nozzle of FIG. 8 shown in exploded relationship with respect to a conventional toilet bowl.

The improved anti-siphon valve 12, with hand spray nozzle 13, according to the invention is best seen in FIGS. 8 and 9. The structure according to the invention achieves simplicity of design, simplicity in the manufacture of components, and minimal use of material (plastic) while additionally providing a hand spray nozzle so as to provide flexibility in directing flush liquid into the bowl to facilitate complete removal of waste material.

The anti-siphon valve 12 includes a housing 53 body portion having means defining a first valve seat 54 (see FIG. 8) and a second valve seat 55, with first and second legs 56, 57 respectively extending from the same side of the housing 53, generally parallel to each other and preferably connected by a small web of plastic 58 to facilitate stabilization thereof. Indicia indicating the direction of flow of liquid through the valve 12 may be provided on the exterior of the legs 56, 57 as shown by the arrows in FIG. 9.

Means are provided defining an anti-siphon air passage 59 associated with the second valve seat 55. This comprises a continuation of the tubular interior of the of second valve seat 55 to the exterior environment with a cap support 60 preferably molded on the housing 53 for supporting a removable cap 61 which prevents entry of foreign material into the valve 12, but does not restrict passage of air from the environment to the valve when breaking of a siphon effect is necessary.

The first leg 56 is connected to the source of fresh water 14, as by hose 62 (see FIG. 9) and is in alignment with the air passage 59. The second leg is operatively connected to the toilet bowl 46, as through the elbow connection 63 (see FIG. 9) and associated fitting 64, which connects to the back of the toilet bowl 46 in a per se conventional manner. However, according to the invention the leg 57 also includes a downwardly extending portion 65 which is connected to the flexible tube 66 and ultimately to the hand spray nozzle 13.

A poppet 69 is mounted in the valve 12 so that the flexible material in the valve portion 67 (e.g. rubber washer) thereof moves between the first valve seat 54 and the second valve seat 55. The interior of the first leg 56 including the enlarged diameter upper portion 68 thereof immediately adjacent the body portion 53 of the housing, guides the poppet 69 for up and down movement. The poppet 69 preferably is elongated in the dimension of leg 56, and includes means for guiding the valve portion 67 thereof during movement between the valve seats 54, 55, while still allowing free flow of water. Preferably four lobes are provided, three of the lobes seen in FIG. 8, circumferentially spaced 90 degrees from each other. The width of the top portion 70 of the poppet 69 is substantially the same as the interior diameter of the upper cavity 68 of the leg 56, while the maximum width portion 71 of the poppet 69 bottom is approximately the same as the interior diameter of the leg 56.

The spray nozzle 13 preferably is conveniently mounted by bracket 72, which is connected by screws 73 or the like to the side or back of toilet bowl 46.

In use, the anti-siphon valve 12 operates as follows: when the toilet is flushed by operation of the movable valve element in a conventional manner (e.g. as in U.S. Pat. No. 3,663,970, the disclosure of which is incorporated by reference herein) and/or by lifting up on the actuator for flushing the toilet, fresh water flows from reservoir 14 through first leg 56 to move the poppet 69 upwardly so that there is no seal made between valve portion 67 and valve seal 54, the water causing the poppet 69 to move up completely so that valve portion 67 is in sealing relationship with valve seat 55. Water then flows from first leg 56 through the interior of housing body 53 and to second leg 57 and through fitting 63, 64 into the interior of the toilet. If it is desirable to direct a portion of this flow at a particular point within the toilet bowl 46, the user removes the spray nozzle 13 from the bracket 72 and actuates it so that a portion of the water flows through conduit 66 through spray nozzle 13 into the bowl 46. Once operation of the fresh water flow to the bowl has terminated it is necessary to insure that a siphon effect does not take place which would continue to draw water from the reservoir 14, and/or allow possible contamination of fresh water source 14 by back up through the valve 12. This is automatically taken care of by the air passage-way 59 which—when water pressure (as under the pressure of a pump) is no longer applied to the poppet 69—allows air to flow through passageway 59 causing the poppet 69 to move downwardly so that the valve portion 67 thereof sealingly engages stationary seal 55.

Figure 11:
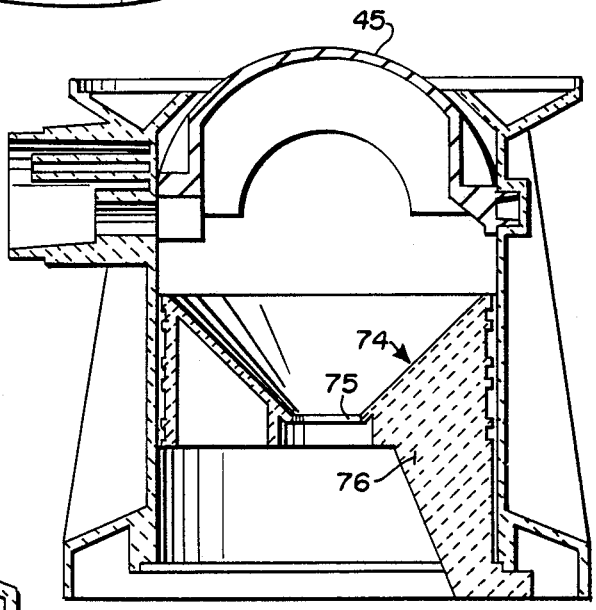
FIG. 11 PRIOR ART
FIG. 11 is a side cross sectional view of a prior art vacuum toilet funnel construction.
Figure 10:
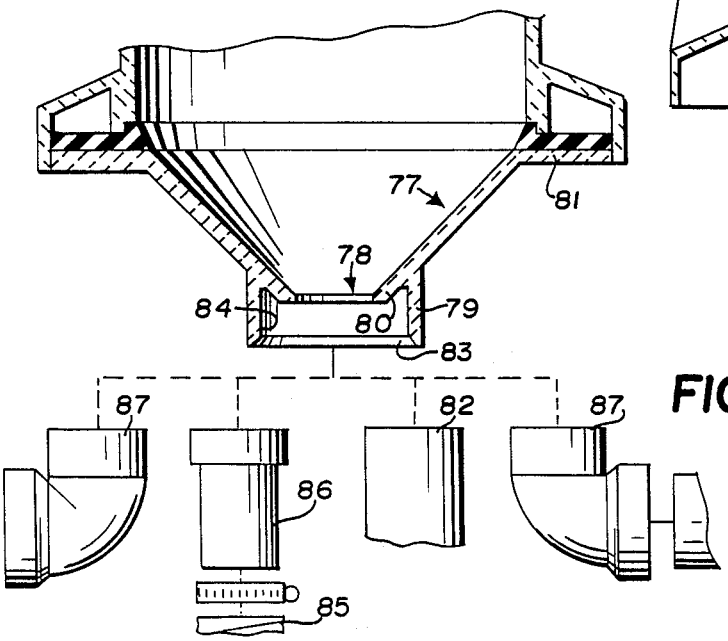
FIG. 10 is a side view, partly in cross section and partly in elevation, illustrating an exemplary funnel according to the invention and the interconnection between the funnel and various conduit components.

A conventional prior art funnel means is illustrated in FIG. 11 by reference numeral 74, comprising an insert terminating in an orifice 75 with at least one solid portion 76 below the orifice 75. According to another aspect of the present invention, enhanced flexibility of the connection of the funnel and orifice to the vacuum tank is provided as illustrated in FIG. 10. In this embodiment the funnel means 77 terminating in knife-edge orifice 78 has an annular collar 79 extending downwardly therefrom, the collar having a large diameter with respect to the orifice 78, and there being a significant "lip" portion 80 of the funnel 77 extending inwardly of the collar 79 so that the orifice 78 is truly "within" the collar 79. The upper portion 81 of the funnel 77 may be suspended or supported from the floor or deck by pedestals or a large annular pedestal (not shown).

FIG. 10 illustrates the interconnection of different components that may be provided utilizing the funnel means with collar 79. For example, 1.5 inch rigid plastic pipe 82 may act as a male element and may be inserted into the interior of the collar (which acts as the female element). Note the bevelled entryway 83 to the collar 79 and the slightly inwardly tapering interior 84 thereof. Alternatively, 1.5 inch inside diameter flexible hose 85 may be connected to the funnel 77 utilizing adaptor 86, which adaptor 86 is inserted into the collar 79. Sill further, an L 87 my be inserted into operative association with the collar 79, the L, in turn, either being connected directly to rigid pipe or through an adaptor to flexible hose. 1.5 inch pipe or hose is typically desirable where the diameter of the orifice 78 is optimized at about 1 inch.

Conventional vacuum tanks in marine vacuum toilet systems have a seam at the middle, comprising two cylindrical portions with rounded ends which are joined at the seam. An inlet nipple of one diameter is connected to one end, and a vacuum switch is operatively connected to the other end, with the outlet extending downwardly from the nipple in the side wall of the tank. Adjustable metal straps strap the tank support pedestals. The improved vacuum tank illustrated in FIGS. 12–14 overcomes the disadvantages associated with such conventional vacuum tanks.

Figure 12:
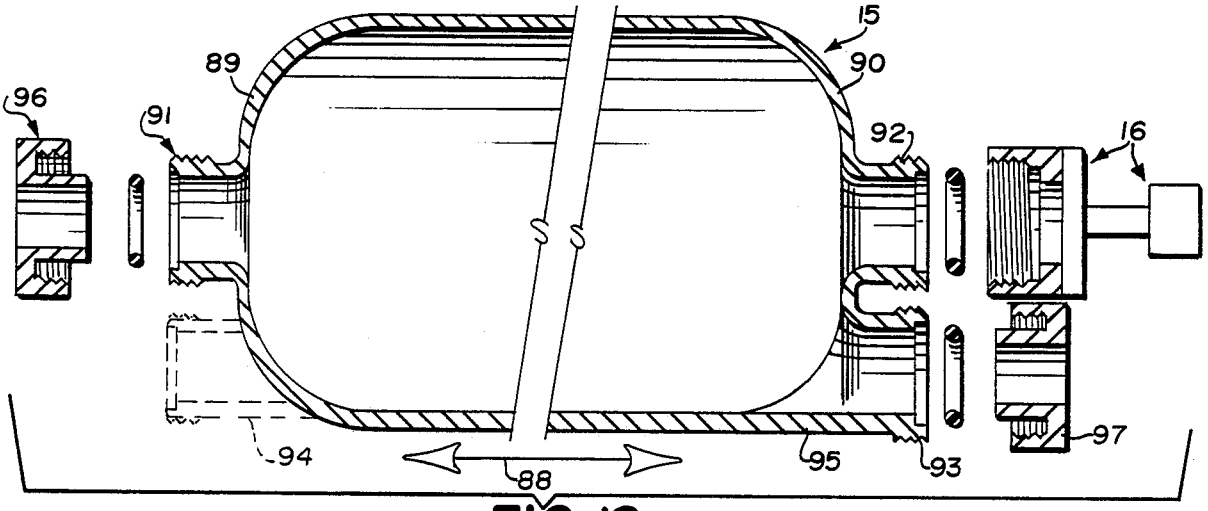
FIG. 12 is an opposite side cross sectional view of a vacuum tank according to the invention.
Figure 13:
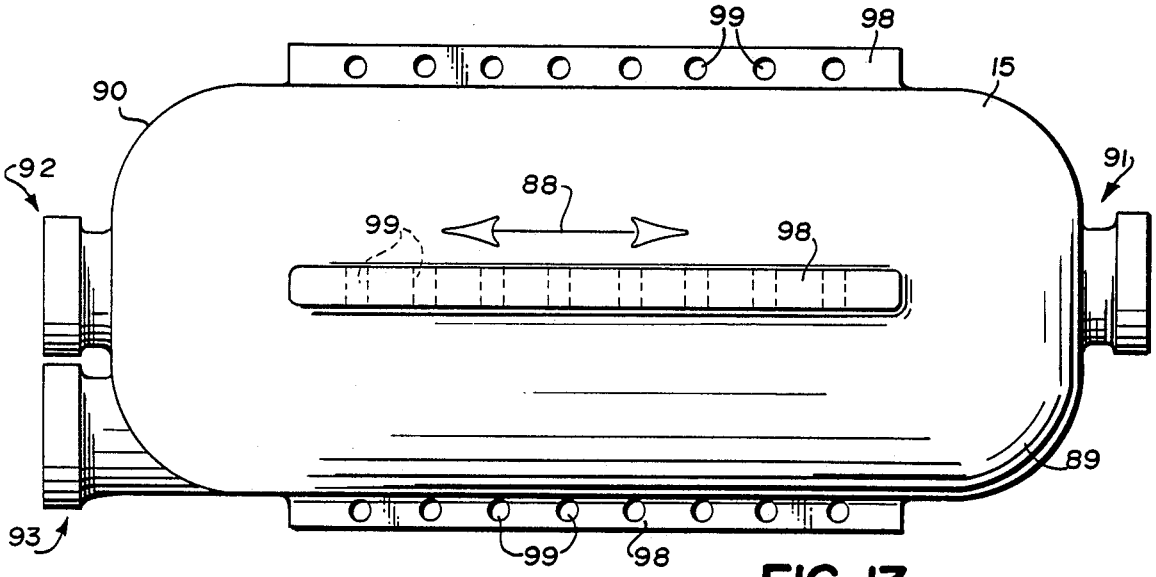
FIG. 13 is a side view of the tank of FIG. 12.
Figure 14:
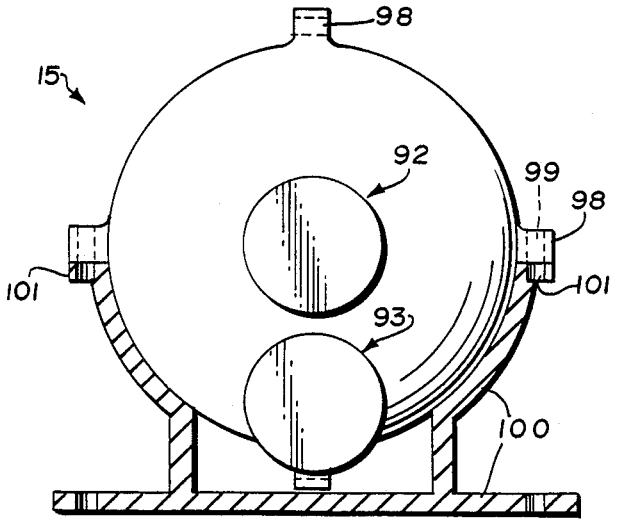
FIG. 14 is an end view of the tank of FIGS. 12 and 13, shown in operative association with the mounting bracket, which bracket is in cross section.
Figure 15:
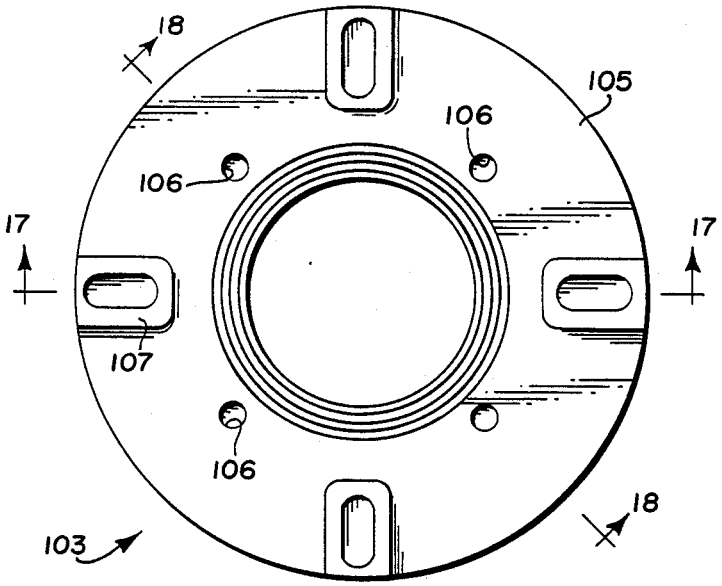
FIG. 15 is a top plan view of an exemplary plug adaptor according to the invention for connection of a vacuum switch to a port of the vacuum tank.
Figure 16:
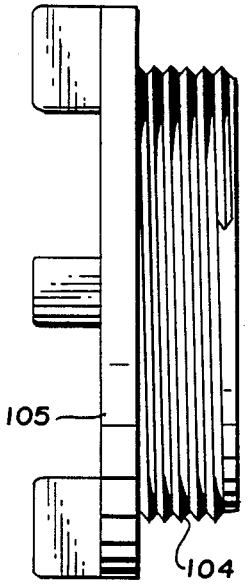
FIG. 16 is a side view of the plug adaptor of FIG. 15.
Figure 17:
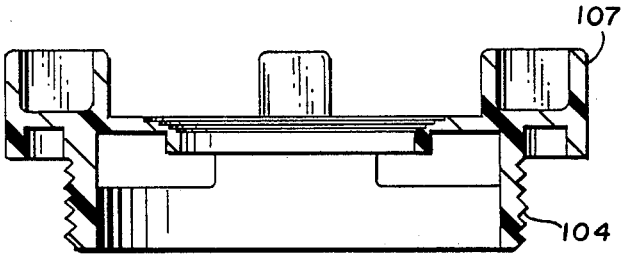
FIG. 17 is a cross sectional view of the plug of FIG. 15 taken along lines 17—17 thereof.
Figure 18:
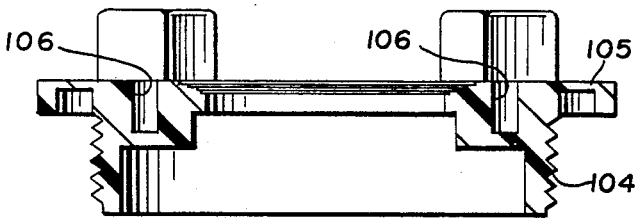
FIG. 18 is a cross sectional view of the plug of FIG. 15 taken along line 18—18 thereof.

The vacuum tank of FIGS. 12–14 may be blow molded from plastic so that it has no seams. The tank is primarily circular in cross-section, and elongated in a dimension 88. The tank has first and second ends 89, 90 and has at least three universal ports. By "universal ports" it is meant that the ports are substantially identical in configuration so that the ports are uniform and may be used to cooperate with each of a wide variety of connecting components so as to provide maximum flexibility for interconnecting tank 15 to other components. For example as illustrated in the drawings a first port 91, a second port 92, and a third port 93 are provided, and preferably also an optional fourth port 94 illustrated in dotted line in FIG. 12. At least one of the ports (e.g. preferably both ports 93, 94) is formed by a continuation portion 95 of the side wall of the tank 15. In this way, if that port (e.g. 93) is used as the outlet from the tank no accumulation of sewage within the tank 15 occurs because there is a stagnant or "sump" portion.

FIG. 12 shows connection of the first port 91 to an adaptor 96 and providing the inlet to the tank, port 92 is connected to a vacuum switch unit 16 for sensing the vacuum within the tank 15 and operating the pump 17 in response thereto; and connection of third port 93 is connected to an adaptor 97 for connection to the outlet conduit which passes to pump 17.

As seen most clearly in FIGS. 13 and 14, the tank 15 also preferably includes longitudinally extending ribs 98 on the exterior thereof. The ribs 98 preferably extend in the dimension of elongation 88 of the tank 15 and are integrally molded with the rest of the tank 15, and include means defining a plurality of through extending openings 99 therein. The openings 99 extend essentially tangential to the tank 15 at the points at which they are provided. At least two opposite ribs 98 are provided and preferably four are provided as illustrated in FIG. 14. The ribs 98 greatly facilitate interconnection of the tank 15 to a stationary support, such as the bracket 100 (see FIG. 14). The bracket 100 itself preferably has a pair of ribs 101 each with at least one opening, and preferably with a plurality of openings cooperating with openings 99 so that bolts secured by nuts can be passed through the ribs 98, 101 to hold them securely together. It will thus be seen that with such a configuration of the tank and associated mounting bracket, a wide variety of different mounting orientations and connection of diverse components to the tank may be readily provided.

Figure 22:
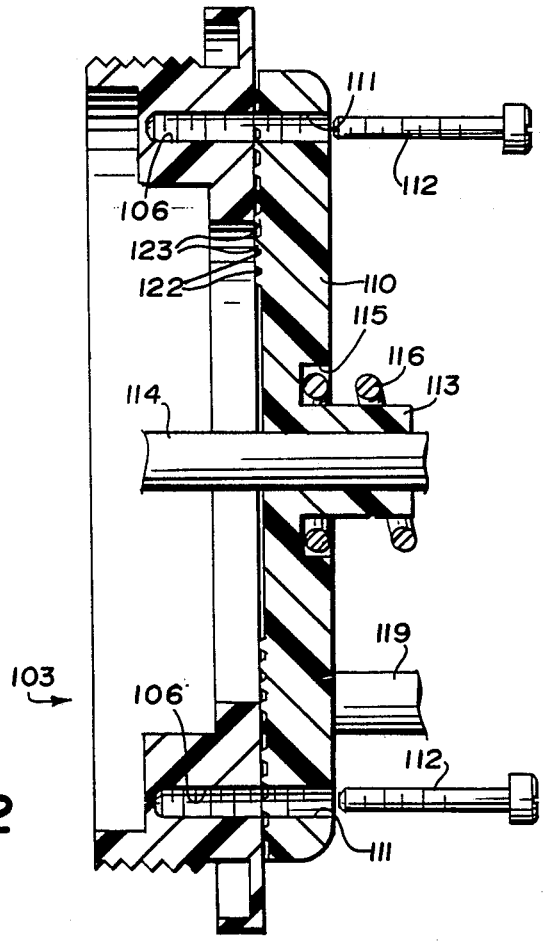
FIG. 22 is a side cross sectional view of the switch mount of FIG. 20 taken along lines 22—22 thereof, and shown in cooperation with fasteners and a plug adaptor which plug adaptor is shown in cross section.

FIGS. 15–22 show various components to facilitate connection of the vacuum switch assembly 16 to a tank 15. FIGS. 15–18 show a plug adaptor according to the invention while FIGS. 19–22 show primarily an electrical switch support mount, although the plug adaptor is also shown in FIG. 22. In these FIGURES it is assumed the tank will have interiorly threaded ports for connection of the components thereto, however that is not necessary and the ports of the tank could equally well be exteriorly threaded (as in FIGS. 12–14) and the threads on the plug adaptor FIGS. 15–18 adjusted accordingly.

The plug 103 includes threaded collar portion 104 for engaging the tank 15 port with which it will be associated and includes a body 105 which is basically annular and includes a plurality of blind holes 106 for receiving fasteners (see FIGS. 15 and 18), preferably four such holes are spaced from each other so that they are on the corners of a square or other quadrate. Access to the holes 106 is provided from the side of the body 105 opposite the threaded collar 104. Upstanding bosses 107 are provided on the body 105 opposite the threaded collar 104. The plug adaptor preferably is formed of nylon or like plastic material.

Figure 19:
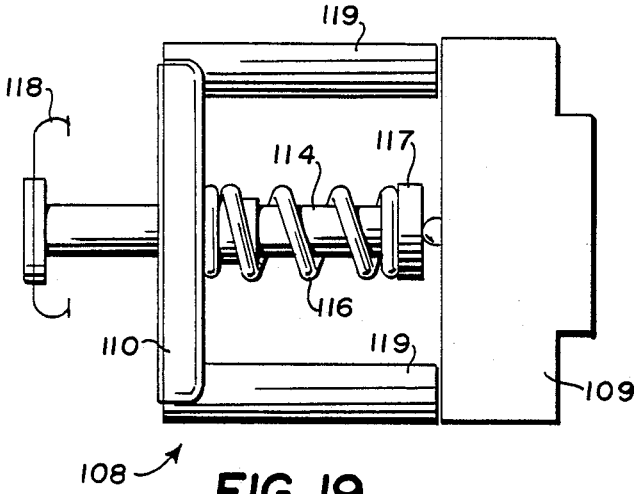
FIG. 19 is a side view of an electrical switch support mount for use with the plug adaptor of FIG. 15, and shown in association with an electrical switch.
Figure 20:
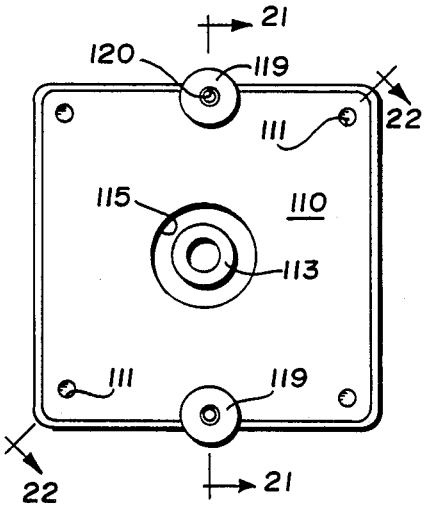
FIG. 20 is a top plan view of the switch mount, per se, of FIG. 19.
Figure 21:
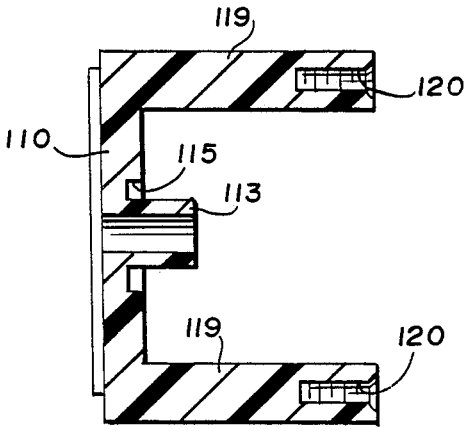
FIG. 21 is a side cross sectional view of the switch mount of FIG. 20 taken along lines 21—21 thereof.

The electrical switch support mount is shown generally by reference numeral 108 in FIGS. 19–22, and it mounts a conventional electrical switch, such as a micro-switch 109 (see FIG. 19). It includes a base portion 110 with a plurality of through-extending openings 111 defined therein, through which fasteners—such as the fasteners 112 of FIG. 22—might pass. The openings 111 (see FIG. 20) are preferably disposed in the corners of a square or like quadrate, having the same spacing from each other as the blind openings 106 and adaptor 103 so that when the openings 111, 106 are in alignment the fasteners 112 may pass therethrough and connect the base 110 to the plug adaptor 103. Note that with such a construction the fasteners 112 will be exterior of the tank environment and therefore need not be made of stainless steel, but may be made of any other desirable, less expensive material that performs a connecting function, such as conventional screw steel.

Note that the mount 108 also includes a centrally located guide bushing 113 for guiding a switch actuator plunger 114 which reciprocates therein, and a recess 115 (see FIG. 22) is provided for a coil spring 116 (see FIGS. 19 and 22) that will surround the plunger 114 and bias the head 117 thereof toward the switch 109. The opposite end of the plunger 114 from head 117, as seen in FIG. 19, is connected up to a stiff diaphragm 118, or other conventional vacuum level responsive material such as is used in conventional vacuum switches in conventional Vacu-Flush® systems. The mount 108 also includes upstanding posts 119 which are in alignment with the central bushing 113 (see FIG. 20) and are at the mid points of the sides of the quadrate base 110 opposite each other and between a pair of holes 111.

These posts also include blind openings 120 (see FIG. 21) which receive fasteners which connect the electrical switch 109 thereto.

The inside face of the base 110 is formed with a plurality of concentric grooves 122 (see FIG. 22)—or alternatively it may be considered that a plurality of upstanding lands 123 are provided therein. In any event, these concentric surface manifestations 122, 123 provide sealing engagement with the plug 103 so the necessity for an O-ring in such a structure (necessary in the prior art) is overcome.

The pump 17 conventionally utilized in a system according to the invention is shown in one or more of U.S. Pat. Nos. 3,529,908, 3,597,517, 3,714,536, and 3,774,461, the disclosures of which are incorporated by reference herein. However, those pumps contain bellows between the movable pump element and the housing, and are subject to the paper compaction problem discussed above and therefore the improved pump according to the invention, as illustrated in FIGS. 23 and 24 is preferably provided.

The pump 17 illustrated in FIGS. 23 and 24 includes a housing 126 which has an inlet 127 and an outlet 128 (preferably connected to check valves as is conventional in present vacuum toilet systems) with a sump area 129 (see FIG. 24) provided in the housing 126 below the inlet and outlet 127, 128. The provision of the sump volume 129 allows the pump to practically and effectively pump sewage slurries and the like even though there may be particles therein with a diameter or effective maximum exterior dimension of about one half inch. The pump 17 also includes a movable pump element 130 (sometimes called a piston) which is connected to a stem 131 (sometimes called a rod). The end 132 of the housing containing the sump 129 is closed, however, the end 133 opposite end 132 is open. According to the invention a rolling diaphragm 134 is connected between the pump movable element 130 and the open end 133 of the housing. A cover, shown in dotted line at 135 in FIG. 24, may be utilized to close the open end 133.

The stem 131 is reciprocated up and down to effect the pumping action by a motor crank assembly which includes a bushing-connector 136 which fits at one end thereof into opening 137 in stem 131, and receives a pin 138 from a crank arm 139 on the other end thereof. The crank arm 139 is connected to shaft 140 of a motor/gear reducer assembly 141. Rotation of shaft 140 from the gear reducer connected to a motor effects rotation of crank arm 139 which in turn effects movement of the stem 131 and movable pump element 130 in dimension 132 (see FIG. 24) to effect the pumping action. The rolling diaphragm does not suffer the same disadvantages as a bellows with respect to paper compaction and thus can be expected to have longer life.

Also according to the invention it is desirable to minimize the cost of the pump 17 by forming the crank 139 of powdered metal. In addition to minimizing costs this provides the crank arm 139—which is a relatively inexpensive component (compared to the elements 130, 131 assembly, gear reducer, or motor)—as the first component to break and thus the fail-safe mechanism.

According to the invention it is also possible to reduce the cost of the pump 17 by forming the stem of plastic. For example in the embodiment illustrated in FIG. 25, the movable valve element 144 is connected to an injection molded plastic stem 145 with the rolling diaphragm 134 (or bellows) received between the components 144, 145. Interconnection between the components 144, 145 preferably is facilitated by a plurality of integral pegs or pins 146 which extend outwardly from the stem 145, and are staked, ultrasonically welded, or otherwise attached to the movable pump element 144 (which preferably also is of plastic).

The operation of the basic vacuum toilet system according to the invention is the same as for the conventional Vacu-Flush® marine toilet system, except that the components thereof are improved and the system advantages such as illustrated in FIGS. 1 and 2 can be obtained. It will thus be seen that an advantageous vacuum toilet system, and component parts therefor, have been provided.

While the invention has been herein shown and described in what is presently considered to be the most practical and preferred embodiment, it will be apparent to those of ordinary skill in the art that many modifications may be made thereof within the scope of the invention, which scope is to be accorded the broadest interpretation of the appended claims so as to encompass all the equivalent structures and devices.

What is claimed is:

1. A vacuum toilet system for a vehicle comprising:

a vacuum toilet including a valve;

a vacuum tank operatively connected to said vacuum toilet below said valve;

a vacuum pump operatively connected to said vacuum tank; and a holding tank operatively connected to said vacuum pump;

said vacuum tank comprising a plastic tank including at least three ports, each of said ports being substantially identical to the other ports to allow interchangeability of the connection between said ports and other components;

an inlet conduit operatively connected to one of said ports;

an outlet conduit operatively connected to another of said ports; and a vacuum sensor operatively connected to a third of said ports;

at least one of said ports defined by a continuation of a wall of said tank so that said port can be operatively connected to an outlet conduit so that no accumulation of sewage material within said tank take place.

2. A vacuum toilet system as recited in claim 1 wherein said tank comprises a plastic material tank circular in cross-section over the majority of the length thereof, and the walls defining the circular cross-section thereof including a wall portion which defines said continuation for said at least one port for connection to said outlet conduit.

3. A vacuum toilet system as recited in claim 2 wherein said tank is formed without seams.

4. A vacuum toilet system as recited in claim 2 wherein said tank includes at least two longitudinal ribs integral therewith and extending along the exterior thereof in the dimension of elongation of said tank, and means defining a plurality of openings in said ribs, said openings being substantially tangential to said tank.

5. A vacuum toilet system as recited in claim 4 wherein four of said ribs are provided evenly spaced from each other around the circumference of said tank.

6. A vacuum toilet system as recited in claim 5 wherein said vacuum tank comprises four ports, so that the opposite ends of said tank are symmetrical, all of said ports being universal ports.

7. A vacuum toilet system as recited in claim 4 further comprising a support bracket for mounting said tank, said support bracket including arcuate portions for engaging the tank wall and ribbed portions for engaging the longitudinal ribs on said tank, said ribbed portions having at least one opening therein which is alignable with one of said plurality of openings in said tank ribs.

8. A vacuum toilet system as recited in claim 1 wherein connection of said vacuum tank, through a universal port, to said vacuum sensor is provided by a plug with connector portions operatively engaging said a port, and an electrical switch support mount, said electrical switch support mount having a base with a plurality of through-extending fastener receiving openings therein, a centrally located plunger guide and a pair of peripherally located support posts; and wherein said plug comprises a plurality of blind fastener receiving openings in alignment with said fastener receiving openings in said support mount base so that fasteners may be passed from the exterior of said base through said base into engagement with said adaptor plug blind openings to hold said electrical switch support mount to said plug adaptor and ultimately said vacuum tank.

9. A vacuum toilet system as recited in claim 8 wherein said base of said electrical switch support mount comprises a plurality of concentric grooves formed therein and cooperating with said adaptor plug so that there is no necessity for an O-ring.

10. A vacuum toilet system as recited in claim 9 wherein said electrical switch support mount base is substantially quadrate in plan, and wherein one of said fastener receiving openings is disposed at each of the corners of said quadrate; and wherein said support posts are disposed along opposite sides of said quadrate in line with said plunger guide, each of said support posts being substantially equidistant between fastener receiver openings.

* * * * *